US009728017B2

(12) United States Patent
Paquin

(10) Patent No.: US 9,728,017 B2
(45) Date of Patent: Aug. 8, 2017

(54) ELECTRONIC DOOR ACCESS CONTROL SYSTEM

(71) Applicant: Yves Paquin, Rosemere (CA)

(72) Inventor: Yves Paquin, Rosemere (CA)

( * ) Notice: Subject to any disclaimer, the term of this patent is extended or adjusted under 35 U.S.C. 154(b) by 268 days.

(21) Appl. No.: 14/193,727

(22) Filed: Feb. 28, 2014

(65) Prior Publication Data

US 2014/0247113 A1 Sep. 4, 2014

Related U.S. Application Data

(60) Provisional application No. 61/771,427, filed on Mar. 1, 2013.

(51) Int. Cl.
*G07C 9/00* (2006.01)
*E05B 47/00* (2006.01)

(52) U.S. Cl.
CPC ..... *G07C 9/00007* (2013.01); *E05B 47/0047* (2013.01); *G07C 9/00174* (2013.01); *G07C 9/0069* (2013.01); *G07C 9/00563* (2013.01); *G07C 2209/62* (2013.01)

(58) Field of Classification Search
CPC ..... G07C 9/00007; G07C 9/00174; E05B 47/0047
USPC ..... 340/5.65, 5.23, 5.6; 235/382; 292/341.16
See application file for complete search history.

(56) References Cited

U.S. PATENT DOCUMENTS 3,979,647 A 9/1976 Perron et al.
4,031,434 A 6/1977 Perron et al.
4,041,434 A 8/1977 Jacobs, Jr. et al.
4,802,353 A 2/1989 Corder et al.
4,851,652 A 7/1989 Imran
4,967,305 A 10/1990 Murrer et al.
5,140,317 A 8/1992 Hyatt, Jr. et al.
5,351,042 A 9/1994 Aston
5,606,615 A 2/1997 Lapointe et al.
6,076,870 A * 6/2000 Frolov ..... E05B 47/0047 292/144

(Continued)

FOREIGN PATENT DOCUMENTS

CA 2623692 A1 4/2007
CA 2700652 A1 4/2007

(Continued)

OTHER PUBLICATIONS

European Search Report for Application No. EP14165305 dated Feb. 27, 2015.

(Continued)

*Primary Examiner* — Joseph Feild
*Assistant Examiner* — Omar Casillashernandez
(74) *Attorney, Agent, or Firm* — Lerner, David, Littenberg, Krumholz & Mentlik, LLP

(57) ABSTRACT

An electronic door lock system comprising a door control unit, a key reader and an encrypted binding between the key reader and the door control unit. When tampering is detected the encrypted binding is terminated thereby preventing the door from being opened. There is also disclosed a method for retrofitting a door comprising a key reader with a door control unit. The door control unit, key reader and the latch release mechanism may also be powered by a key comprising a power supply, the key also supplying a coded sequence to the door control unit.

11 Claims, 12 Drawing Sheets

(56) References Cited

U.S. PATENT DOCUMENTS

| | | | | |
|---|---|---|---|---|
| 7,161,276 | B2 | 1/2007 | Face | |
| 7,311,526 | B2 | 12/2007 | Rohrbach et al. | |
| 7,517,222 | B2 | 4/2009 | Rohrbach et al. | |
| 7,645,143 | B2 | 1/2010 | Rohrbach et al. | |
| 7,862,091 | B2 * | 1/2011 | Escobar | E05B 47/023 292/201 |
| 7,901,216 | B2 | 3/2011 | Rohrbach et al. | |
| 7,958,758 | B2 | 6/2011 | Trempala et al. | |
| 8,035,477 | B2 | 10/2011 | Kirkjan | |
| 8,087,939 | B2 | 1/2012 | Rohrbach et al. | |
| 8,177,560 | B2 | 5/2012 | Rohrbach et al. | |
| 2002/0178385 | A1 * | 11/2002 | Dent | G07C 9/00309 726/27 |
| 2008/0041943 | A1 * | 2/2008 | Radicella | G07C 9/00087 235/382 |
| 2008/0252415 | A1 * | 10/2008 | Larson | G07C 9/00309 340/5.73 |
| 2009/0115196 | A1 * | 5/2009 | Stango | E05B 13/101 292/61 |
| 2011/0252845 | A1 | 10/2011 | Webb et al. | |
| 2012/0047972 | A1 | 3/2012 | Grant et al. | |
| 2012/0139563 | A1 * | 6/2012 | Teissier | G06F 3/044 324/679 |
| 2012/0178271 | A1 | 7/2012 | Rohrbach et al. | |
| 2013/0027177 | A1 * | 1/2013 | Denison | G07F 11/002 340/5.23 |

FOREIGN PATENT DOCUMENTS

| | | | | |
|---|---|---|---|---|
| CA | 2701706 | A1 | 4/2007 | |
| EP | 0104767 | A2 | 4/1984 | |
| GB | 2395978 | A | 6/2004 | |
| IL | WO 2012014143 | A2 * | 2/2012 | E05B 47/0611 |
| WO | 0077330 | A1 | 12/2000 | |
| WO | 2007037807 | A1 | 4/2007 | |
| WO | 2008034022 | A2 | 3/2008 | |
| WO | 2012031065 | A1 | 3/2012 | |

OTHER PUBLICATIONS

Partial European Search Report for Application No. EP14165305 dated Oct. 2, 2014.

* cited by examiner

ELECTRONIC DOOR ACCESS CONTROL SYSTEM

CROSS REFERENCE TO RELATED APPLICATIONS

This application claims benefit, under 35 U.S.C. §119(e), of U.S. provisional application Ser. No. 61/771,427 filed on Mar. 1, 2013 which is incorporated herein in its entirety by reference.

FIELD OF THE INVENTION

The present invention relates to an electronic door access control system. In particular, the present invention relates to a system comprising a door control unit (DCU) for restricting access via a selectively lockable door way.

BACKGROUND TO THE INVENTION

One drawback with prior art electronic door access systems is that many of the elements necessary to open the door are collocated with either the key reader, the door lock or the striker plate. This means that the prior art door locks are relatively easy to compromise. Another drawback shown in the art is that in order to operate, the door must be supplied with a source of power, which is typically by means of a collocated battery or power supply attached to the mains.

SUMMARY OF THE INVENTION

The present invention overcomes the above and other drawbacks by providing an electronic door access control apparatus for restricting access via a door installed in a door frame and comprising a lock mechanism having a latch bolt and using a key comprising a unique coded ID sequence. The apparatus comprises a key reader for reading the key and comprising a tamper switch, a latch release mechanism, a door control unit separate from the key reader and the latch release mechanism, installed in the door frame proximate to the key reader and the latch release mechanism and comprising a controller and memory comprising a plurality of predetermined allowed coded ID sequences, wherein the door control unit is operationally connected to the tamper switch, and an encrypted binding between the key reader and the door control unit. When the key is positioned proximate to the key reader, the coded ID sequence is read by the key card reader and relayed to the door control unit via an encrypted communication channel for processing, wherein when the coded ID sequence matches one of the plurality of predetermined allowed coded ID sequences, the door control unit actuates the latch release mechanism, thereby allowing the door to be opened, and further wherein when the DCU detects tampering of the key reader via the tamper switch, the encrypted binding between the key reader and the door control unit is terminated.

There is also provided a method for retrofitting an existing electronic door access control system for restricting access via a door and comprising a lock mechanism having a key reader for reading a key comprising a unique coded ID sequence, a latch release mechanism and a power supply. The method comprises associating a tamper detector having an output with the key reader, interconnecting the key reader and the latch release mechanism using a relay, wherein the relay is normally closed, and controlling opening and closing the relay with a resettable door control unit powered by the power supply, wherein the tamper detector output is input into the door control unit. When tampering is detected via the input, the door control unit opens the normally closed relay and thereby preventing the key reader from actuating the latch release mechanism.

Additionally, there is provided an electronic door access control system for restricting access via a door comprising a lock mechanism having a latch bolt. The system comprises a key comprising a unique coded ID sequence and a key memory, a key reader for reading the key, a latch release mechanism, and a door control unit comprising a controller, a real time clock, a door control unit memory and a door identifier. When the key is positioned proximate to the key reader, the coded ID sequence is read by the key card reader and relayed to the door control unit and further wherein when the coded ID sequence matches one of the plurality of predetermined allowed coded ID sequences, the door control unit actuates the latch release mechanism, thereby allowing the door to be opened, and further wherein a time stamp and the door identifier is relayed to the key for storage in the key memory.

Also, there is provided an electronic door access control system for restricting access via a door installed in a door frame and comprising a lock mechanism having a latch bolt. The system comprises a key comprising a unique coded ID sequence and a power source having a key voltage, a key reader for reading the key, a latch release mechanism configured for receiving the latch bolt and comprising a striker plate and a solenoid only actuatable using an actuating voltage greater than the key voltage, and a door control unit comprising a controller, a door control unit memory and a charge pump, an output of the charge pump connected across an input of the solenoid. When the key is positioned proximate to the key reader, the key power source supplies power for operating the key reader and the door control unit and further wherein once powered the coded ID sequence is received by the key card reader and relayed to the door control unit and further wherein when the coded ID sequence matches one of the plurality of predetermined allowed coded ID sequences, the door control unit activates the charge pump using the key voltage, the charge pump raising the key voltage to the actuating voltage thereby actuating the solenoid and allowing the door to be opened.

DETAILED DESCRIPTION OF THE ILLUSTRATIVE EMBODIMENTS

Figure 1:
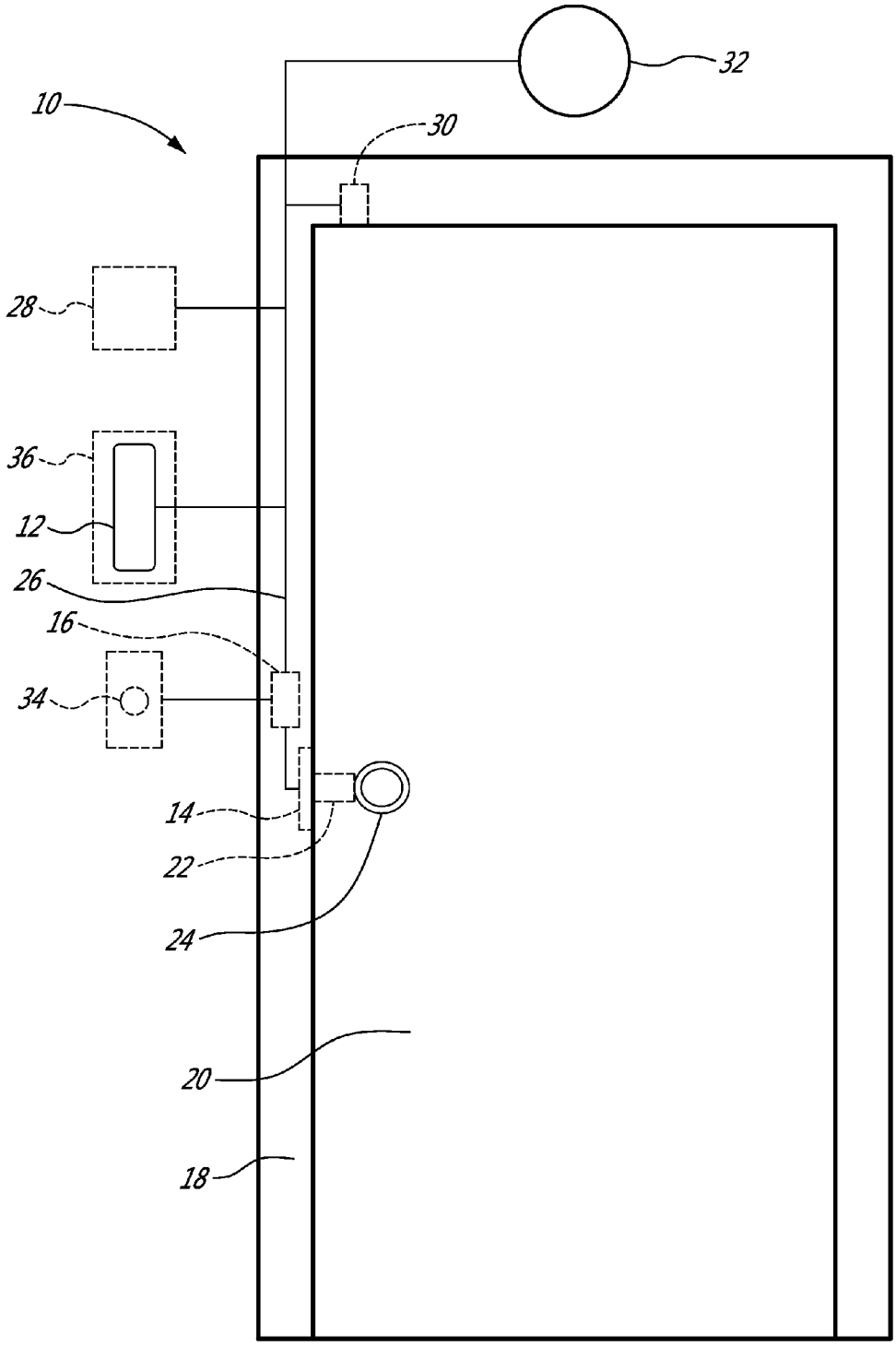
FIG. 1 provides a schematic view of an electronic door access control system in accordance with an illustrative embodiment of the present invention.

Referring now to FIG. 1, an electronic door access control system, generally referred to using the reference numeral 10, will now be described. The door access control system 10 comprises a key reader 12 and latch release mechanism 14 interconnected by a Door Control Unit (DCU) 16. The system is illustratively for use on a standard doorway comprising a metal door frame 18, door 20 and bored cylindrical lock 22 comprising a handle 24, or mortise lock, or the like. The DCU 16 is separate from the key reader 12 and, as will be discussed in more detail below, installed embedded in the door frame 18. The DCU 16 is interconnected with the key reader 12 illustratively via a communication cable 26 and an encrypted communications protocol. In a first illustrative embodiment the system 10 comprises an external power source 28, such as a power supply connected to the mains (not shown). Alternatively, the key reader 12 or DCU 16 could comprise an Ethernet interface (for example for connection to an external computer network or the like, not shown) and the power necessary for system operation provided via an appropriate network switch and a Power over Ethernet (PoE) connection.

Still referring to FIG. 1, in particular embodiments other peripheral devices could be included, for example a contact switch 30 for providing input to the DCU 16 that the door 20 is open or closed, an external alarm 32 for indicating that the door is ajar or has been forced, and a Request to Exit (REX) release 34 for generating a REX signal for disengaging the latch release mechanism 14 (from inside the restricted access area, for example) such that the restricted access area can be easily exited. Additionally, and as will be discussed in more detail below, a tamper switch 36 can be provided that senses if the key reader has been tampered with, for example by attempted removal of the keypad 12 or the like. Note that, although the key reader 12 is shown as being installed on the wall adjacent the door frame 18, in a particular embodiment the key reader 12 and tamper switch 36 are mounted to the door frame 18 immediately above the latch release mechanism 14.

Figure 2B:
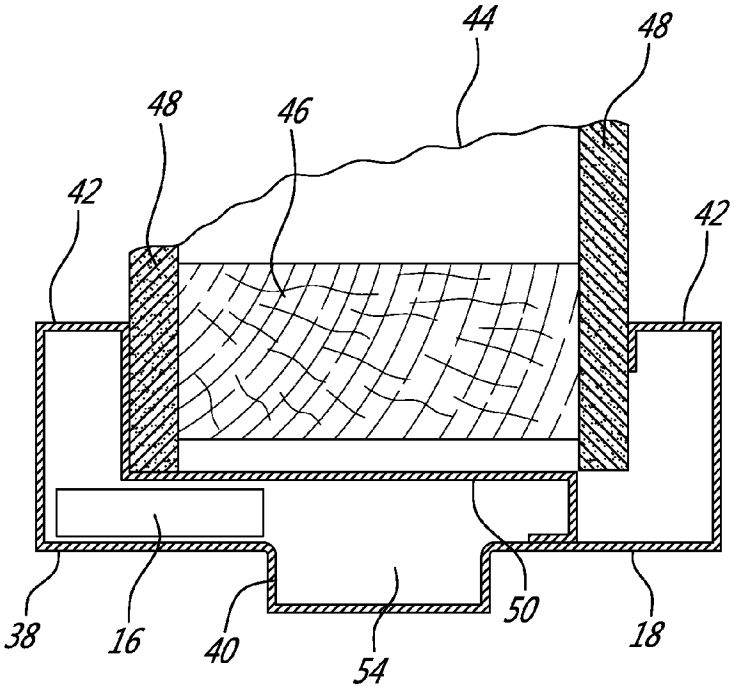
FIG. 2B provides a sectional view along 2B-2B of the door frame of FIG. 2A.
Figure 2A:
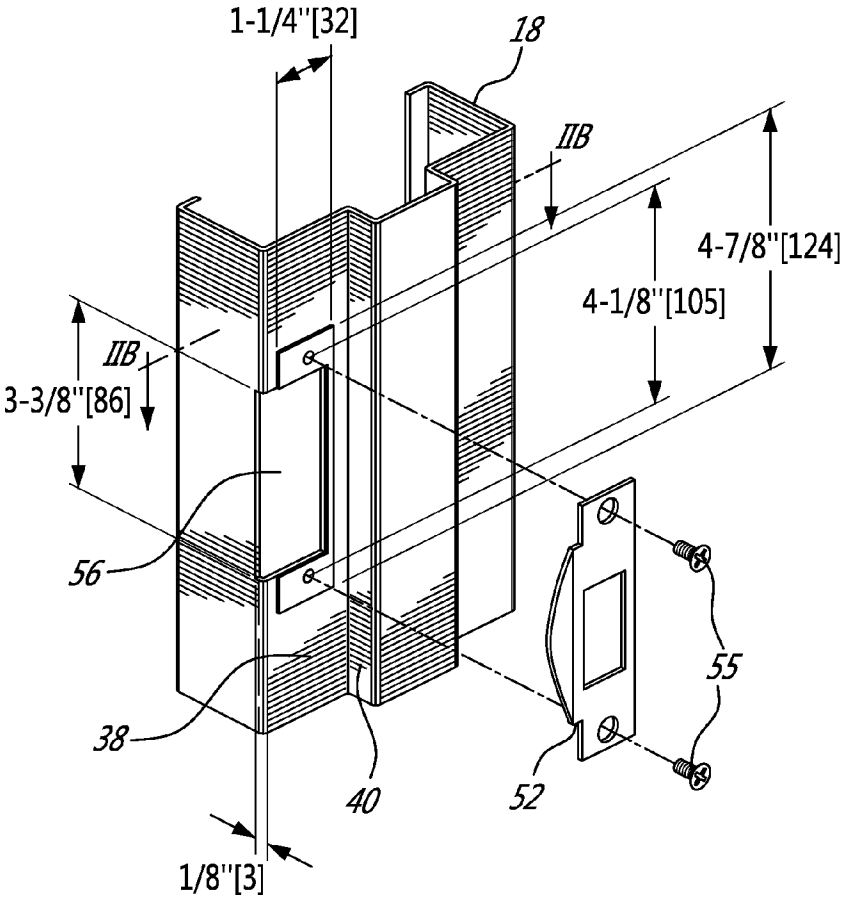
FIG. 2A provides a detailed perspective view of a door frame and striker plate.

Referring now to FIGS. 2A and 2B, the frame 18 is typically manufactured from sheet steel or the like and illustratively shaped to include a door rabbet 38, door stop 40 and opposed flanges as in 42. The flanges 42 provide for installation onto a conventional wall 44, for example constructed of wood or metal studs 46 covered in a paneling material 48, such as sheets of gyp rock or the like. Once the frame 18 is installed on the wall 44, a gap or space is typically left between the frame 18 and the studs 46. In a particular embodiment a reinforcing plate 50 is provided extending several inches along the frame 18 at the height of the striker plate 52 and providing an enclosed region 54.

Still referring to FIGS. 2A and 2B, the striker plate 52 is installed at lock level, typically between 38" and 42" above floor level, by means of screws as in 55 or the like. In this regard, many prefabricated metal door frames as in 18 include a small precut slot 56 in the door rabbet 38 over which the striker plate 52 is installed. A typical such slot 56 is cut to an ANSI standard for receiving a standardized dust box therein.

Still referring to FIGS. 2A and 2B, in order to retrofit the electronic door access control system 10 of the present invention to a previously installed door frame 18, the DCU 16 is designed to fit through the precut slot 56. A small hole (not shown) is cut in the outer flange 42 of the door frame 18 above the precut slot 56 and at the level the key reader 12 and tamper switch 36, if required, is to be installed at. The communication cable 26 is fed via the hole to the precut slot 56, connected to the DCU 16 which is then inserted into the enclosed region 54 or gap. The latch release mechanism 14 can then be installed, covering the enclosed region 54 or gap and the DCU 16. Power for energizing the system can be provided by an external power supply, for example by pulling an appropriate power cable from the power supply (reference 28 on FIG. 1), or battery or the like.

Figure 3:
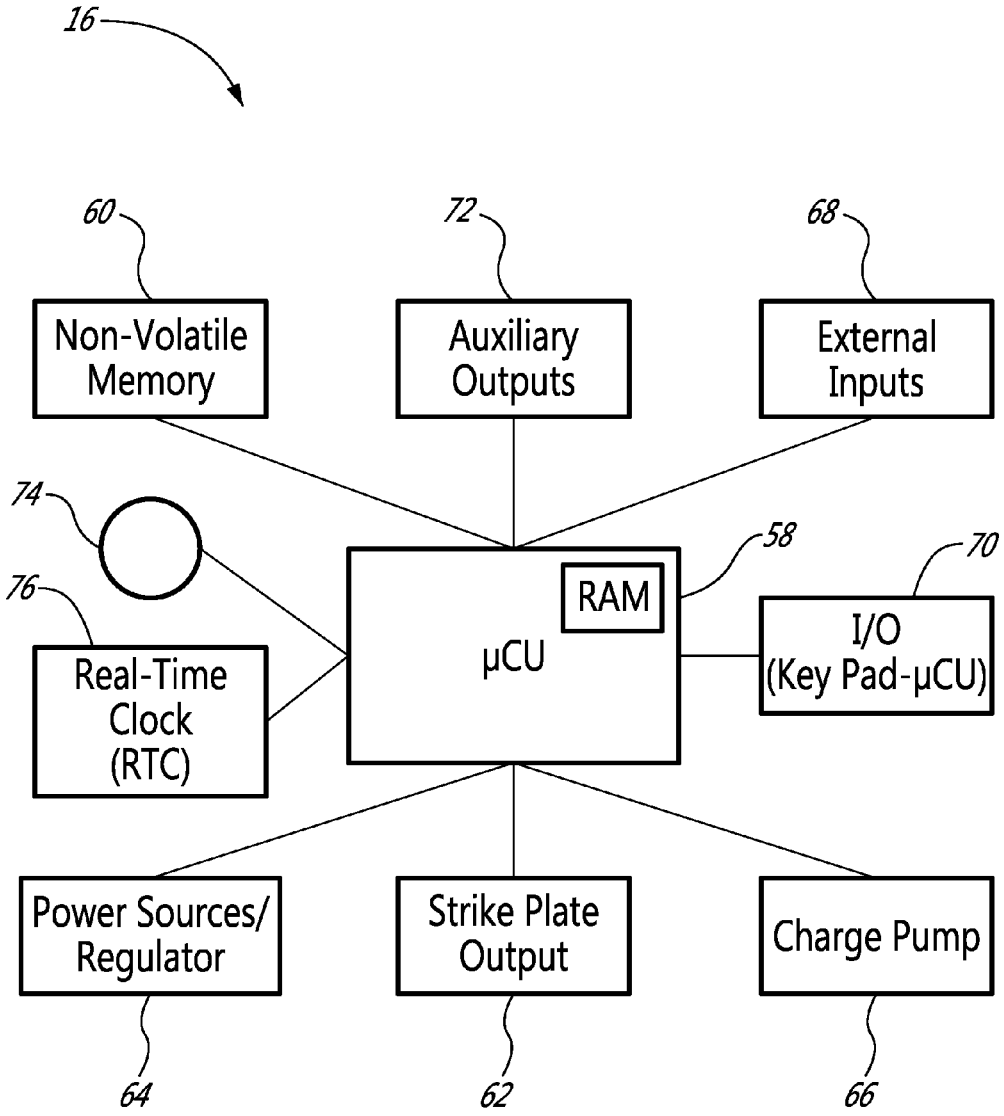
FIG. 3 provides a block diagram of a Door Control Unit (DCU) in accordance with an illustrative embodiment of the present invention.

Referring now to FIGS. 1 and 3, the DCU 16 is comprised of a microprocessor/controller 58 which, using programs and predetermined allowed coded ID sequences stored in non-volatile memory 60, generates signals for enabling the latch release mechanism 14 via the strike plate output 62. When the system is battery operated, the latch release mechanism 14 typically requires voltage and current at levels greater than that provided by the power source 64 (in this case, the battery) and used by the DCU 16 for correct operation of its electronic circuits, and therefore a charge pump 66 is provided. As known in the art, the charge pump, such as a mono-stable multi-vibrator or the like, can raise DC voltages above those of a supplied voltage in order to address differing operating requirements. The microprocessor 58 receives external inputs 68 from the various input devices, such as the door contact sensor 30 and the latch mechanism disengaging push button 34, the tamper switch 36 as well as communications from the key reader 12 via the I/O interface 70, and enables the appropriate strike plate output 62 and/or activates the appropriate auxiliary output 72, such as the alarm 32. A LED 74 or other means is also provided to indicate mode of operation of the DCU 16. A Real Time Clock (RTC) 76 can also be provided in order to provide time stamps or the like.

Still referring to FIG. 3, in a particular embodiment, as the DCU 16 has a limited number of outputs, the DCU 16 can communicate with other similar DCUs as in 16 via the I/O interface 70. In this regard, the physical connections (for example conductive wires or the like) between the key reader(s) as in 12 and the DCUs as in 16 provide a bus for the communications protocol(s) used by the key reader(s) as in 12 and the DCU(s) as in 16 to communicate. As will be discussed in more detail below, this provides additional versatility thereby allowing the DCU 16 to be used in a variety of different settings. Also, for monitoring purposes or the like a wireless (not shown) interface could be provided.

Figure 4A:
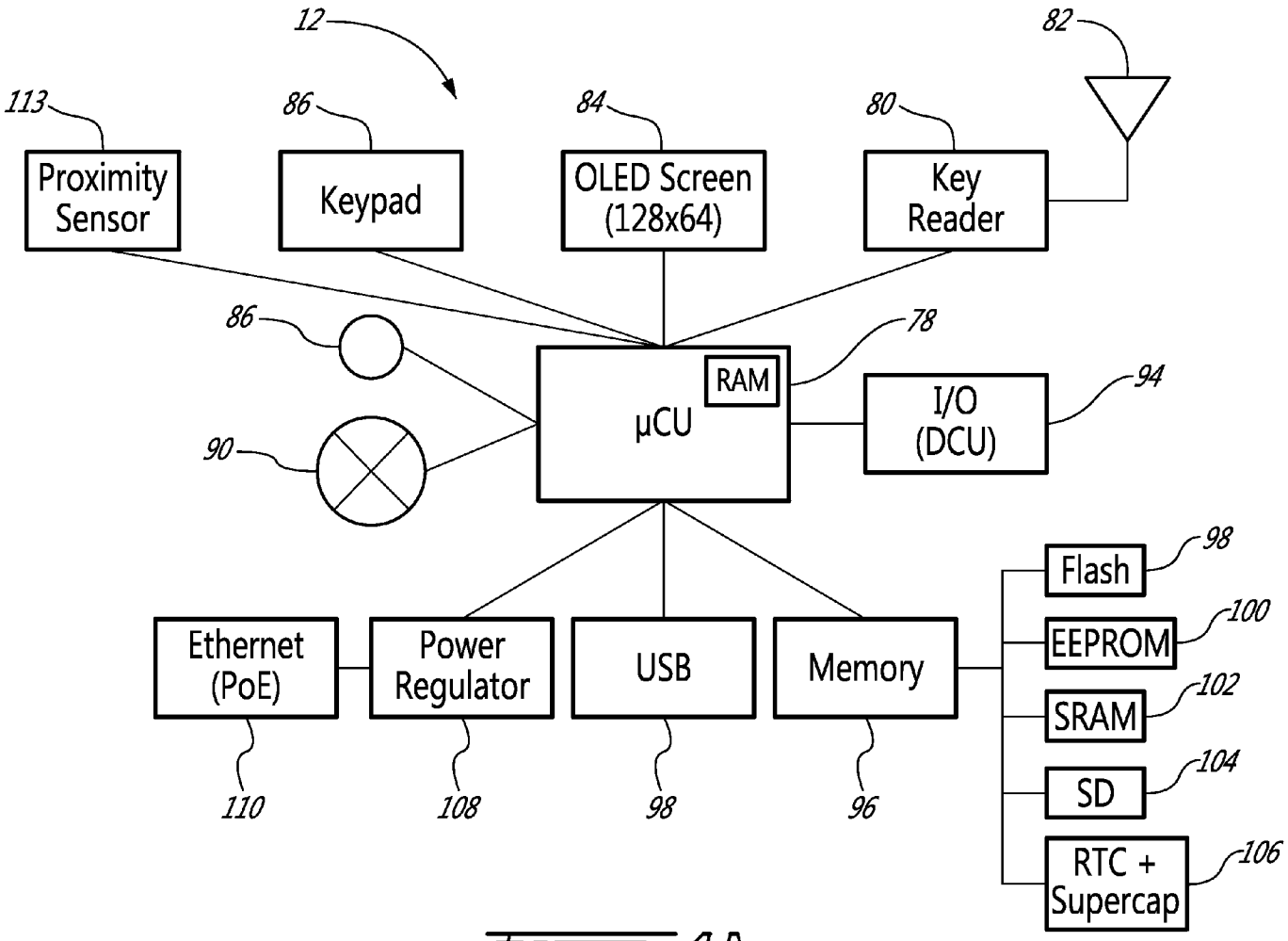
FIG. 4A provides a block diagram of a key reader in accordance with an illustrative embodiment of the present invention.

Referring now to FIG. 4A in addition to FIG. 1, in a first embodiment the key reader 12 is comprised of a microprocessor/controller 78, a coded key receiver 80 and associated antenna 82, a small OLED screen 84, a three button keypad 86, for example using infrared sensors or the like, a USB interface 88, a buzzer 90, status LED 92 and a DCU I/O interface 94 for communicating with the DCU(s) 16. A memory 96 is also provided which can include Flash Memory 98, EEPROMs 100, SRAM 102, SD Memory Cards 104 and the like. Additionally, a Real Time Clock (RTC) and supercap circuit 106 are provided for generating appropriate time stamps and memory backup during power down or the like. Although the key reader 12 may be powered via the DCU I/O interface 94, in a particular embodiment a power regulator 108 is also provided to condition the voltage of power being supplied, for example, via a Power over Ethernet connection 110 or battery or the like, such that it is at appropriate levels for correct operation of the key reader 12. Of note is that in this particular embodiment, power received via the Power over Ethernet connection 110 and conditioned by the power regulator 108 may also be provided to the DCU 16 via the DCU I/O interface 94. In a particular embodiment the USB interface 88 may also be used to power the key reader 12 and DCU 16 with provision of an appropriate USB power supply (not shown).

Still referring to FIG. 4A in addition to FIG. 1, using programs stored in the Flash memory 98, EEPROM 100 and/or SRAM 102, for example, the microprocessor 78 receives IDs of coded key cards (not shown) held in proximity to the Key Reader interface 80 and communicates the appropriate information to the DCU 16, for example using an encrypted protocol or the like. In this regard, use of an encrypted communication between the key reader 12 and the DCU 16 is useful in that it further reduces the likelihood that the door opening mechanism can be compromised, for example by installing a protocol reader between the key reader 12 and the DCU 16. The OLED screen 84 is used to provide appropriate feed back to the user, for example to prompt the user to enter a pin number via the keypad 86. The status LED 92 provides system status as well as useful feedback, for example during servicing of the key reader 12 or the like. The buzzer 90 provides audio cues to the user that the door 20 can be opened, or that the user's coded key card (not shown) has been refused.

Still referring to FIG. 4A in addition to FIG. 1, as will be discussed in more detail below, the SD Memory card interface 104 (or alternatively the USB interface 88 with provision of a USB flash drive or the like, not shown) can be used to retrieve data stored by the DCU 16 for administrative purposes, for example as to coded IDs which have attempted to gain access or gained access to the restricted area via the door 20, as well as time stamps and the like. Additionally, the SD Memory card interface 104 (or alternatively the USB interface 88 with provision of a USB flash drive or the like) can be used to provide a convenient mechanism to provide software updates for the key reader 12 and the DCU 16. In this regard, software updates include not only operating software for ensuring correct functioning of the electronic door access control system 10, but also access control information, such as allowed coded IDs, hours and dates when users associated with the coded IDs are entitled to enter the restricted area via the door 20 and the like.

Figure 4B:
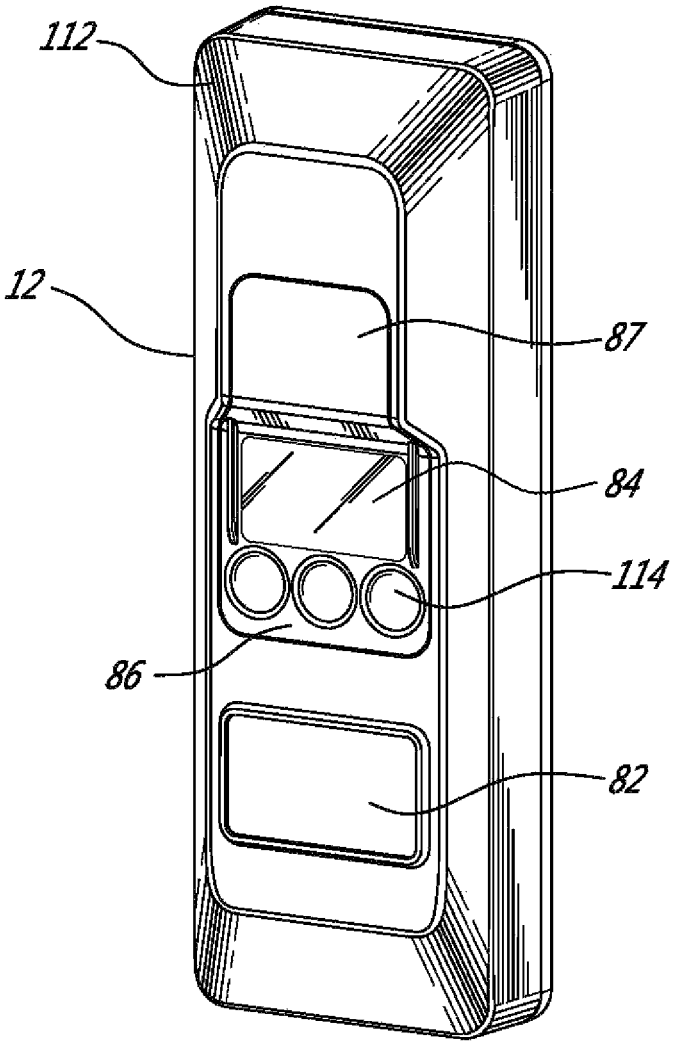
FIG. 4B provides a front perspective view of the key reader in FIG. 4A.

Referring now to FIG. 4B in addition to FIG. 1, the key reader 12 comprises a housing 112 which is secured in proximity to the door 20, for example on the door frame 18 or the wall adjacent the door frame 18. As discussed above a communications cable 26 (not shown) is fed through a hole bored in the frame 18 or the like to interconnect the key reader 12 with the DCU 16 via their respective I/O interfaces 70, 94. In order to improve the security of the installed system, at this point of the installation process the key reader 12 and DCU 16 are typically prompted, for example using an external programming device or master key card (both not shown), to exchange an encrypted or coded sequence in order to bind them to one another. Binding in such a manner ensures that a given key reader 12 and DCU 16 communicate using an encrypted protocol which is only known to them, and such that they can only communicate with one another. This ensures that a given key reader 12 and/or DCU 16 cannot be used elsewhere, for example in an attempt to tamper with another system or the like.

In a particular embodiment, once the key reader 12 and DCU 16 have been bound to one another, in the event an indication is received via the tamper switch 36 that the keypad 12 (or other parts of the system) is being tampered with, the DCU 16 wipes or otherwise disables the bindings, effectively blocking the system from being used to operate the latch release mechanism 14. In order to use the electronic door access control system subsequently, the binding between the key reader 12 and DCU 16 would have to be reestablished, for example using an external programming device or master key card.

Still referring to FIG. 4B in addition to FIG. 1, as discussed above, in a first embodiment, the key reader 12 comprises an antenna 82, an OLED screen 84 and a key pad 86 comprising three keys as in 114. In this regard, the keys as in 114 are programmable and allow the user to migrate menus displayed on the screen 84, that is the programming of the keys 114 is able to change dependent on the screen, context and/or particular menu entry selected. Illustratively, the keys could be programmed to comprise an "up" key and a "down" key for scrolling through a series of numeric or alphanumeric characters, and a select key for selecting one of the characters when arrived at during scrolling. In this way the user can construct a Personal Identification Number (PIN) or Alphanumeric password or the like to further limit the possibility that access to the restricted area is compromised, for example by inappropriate use of another user's coded ID card or the like. A status LED 87 is also provided.

In a particular embodiment the three button keypad 86 can be replaced or combined with a proximity sensor 113 which uses an electric field for sensing and recognizing the motion of a user's hand or finger. A particular embodiment of such a sensor is manufactured under the GestIC™ brand. The proximity sensor tracks the user's hand or finger motion in free-space and in a 3D coordinate system (x-y-z). For example moving a finger above the proximity sensor in a circular motion can be used to scroll through screen selections, which can be selected by tapping the screen. As per the keypad 86 this allows the user to enter additional security information such as pin numbers or passwords and the like.

Figure 4C:
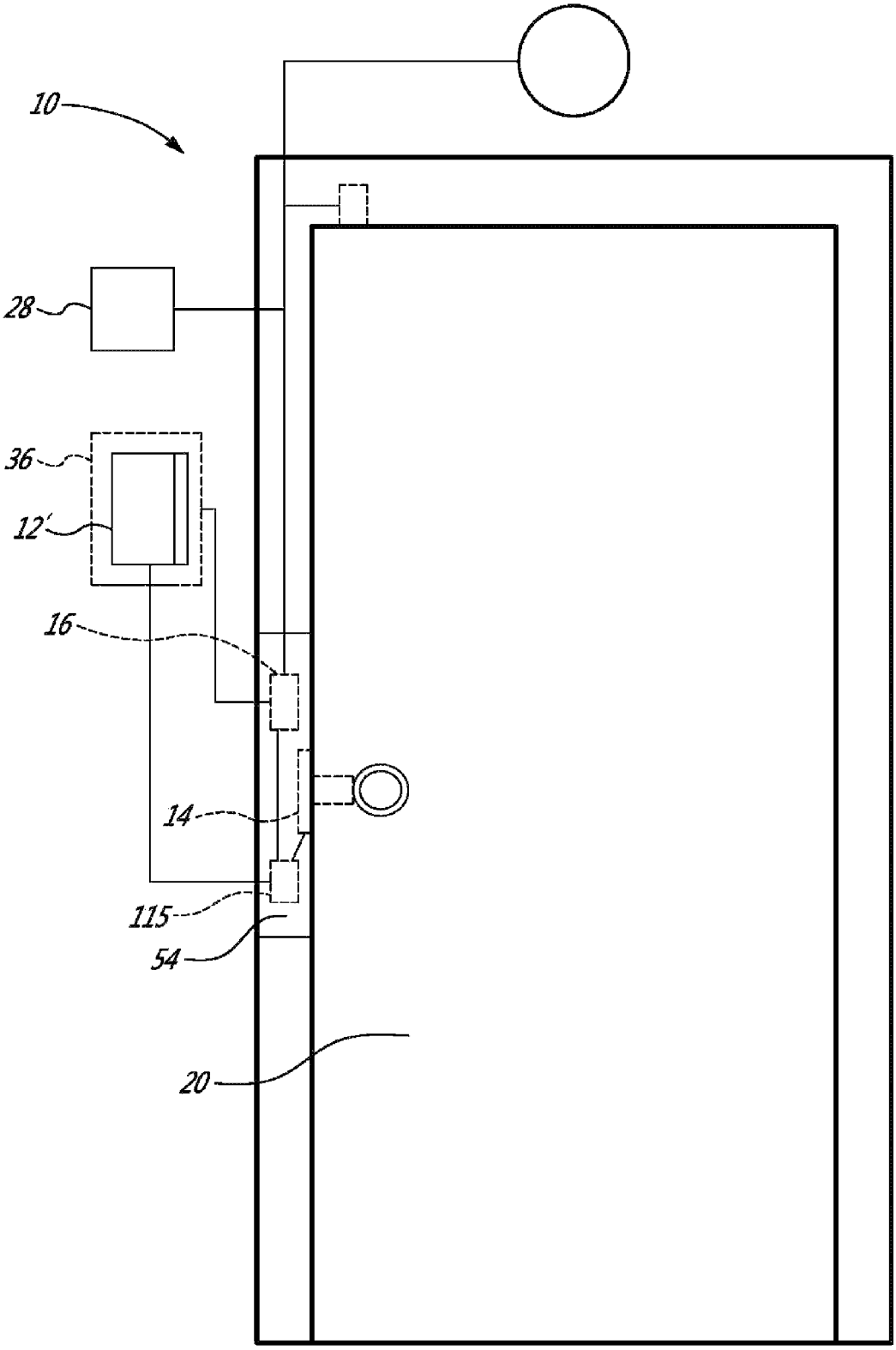
FIG. 4C provides a schematic view of an electronic door access control system in accordance with an alternative illustrative embodiment of the present invention.

Referring now to FIG. 4C, in an alternative embodiment of the electronic door access control system 10, the DCU 16 can be used to retrofit a preexisting key reader 12', such as a Wiegand key reader, magnetic card strip reader or any other suitable type of key reader. In this regard, the DCU 16 is not in direct communication with the preexisting key reader 12'. Illustratively, the DCU 16 is supplied current from the power supply 28 used to supply the preexisting key reader 12'. The tamper switch 36 is similarly installed behind preexisting key reader 12' and connected to an input of the DCU 16, the output of which is in turn connected to a relay 115, also installed within the enclosed region 54 or gap, which controls the connection between the preexisting key reader 12' and the latch release mechanism 14. Initially, the DCU 16 is enabled, for example using a programming cable or the like and a programming device (both not shown), such that the DCU 16 controls the relay 115 to interconnect the preexisting key reader 12' with the latch release mechanism 14. As such, the preexisting key reader 12' can be used normally to actuate the latch release mechanism 14 thereby opening the door. In the event a tampering event is detected via the tamper switch 36, the DCU 16 disables the relay 115 thereby severing the connection between the preexisting key reader 12' and the latch release mechanism 14, and as a result entry via the door 20 is prohibited until such time as the DCU 16 is reprogrammed, for example using the programming cable or the like and programming device. In a particular embodiment a plurality of tamper switches as in 36 can be provided, for example attached to different components of the system susceptible to tampering, such as the buzzer or power supply or the like.

Still referring to FIG. 4C, the illustrated alternative embodiment of the electronic door access control system 10 has the advantage that it can be used to protect existing systems without affecting their method of control or requiring integration into their respective control systems or the like.

Figure 5A:
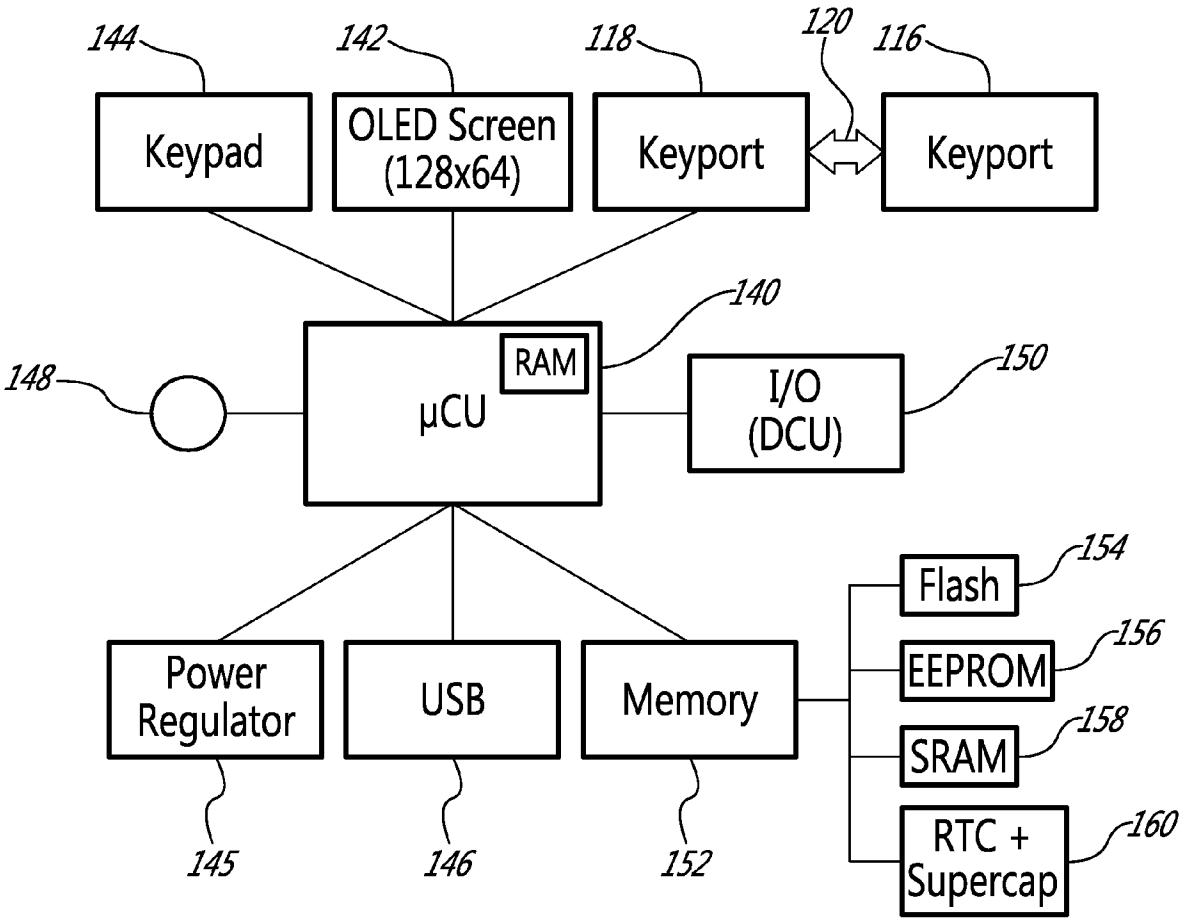
FIG. 5A provides a block diagram of a key reader and key in accordance with an alternative illustrative embodiment of the present invention.
Figure 5B:
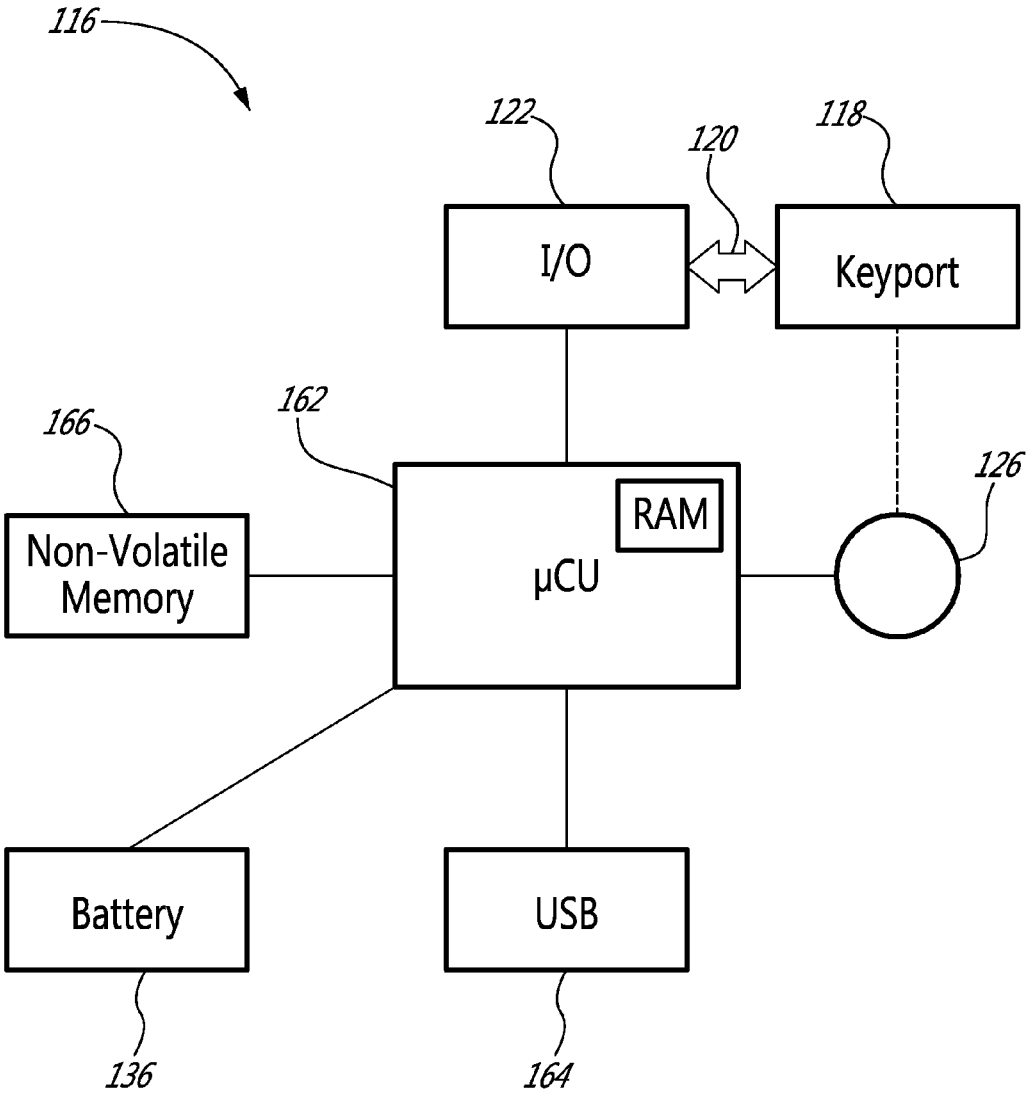
FIG. 5B provides a block diagram of a key in accordance with an alternative illustrative embodiment of the present invention.
Figure 5C:
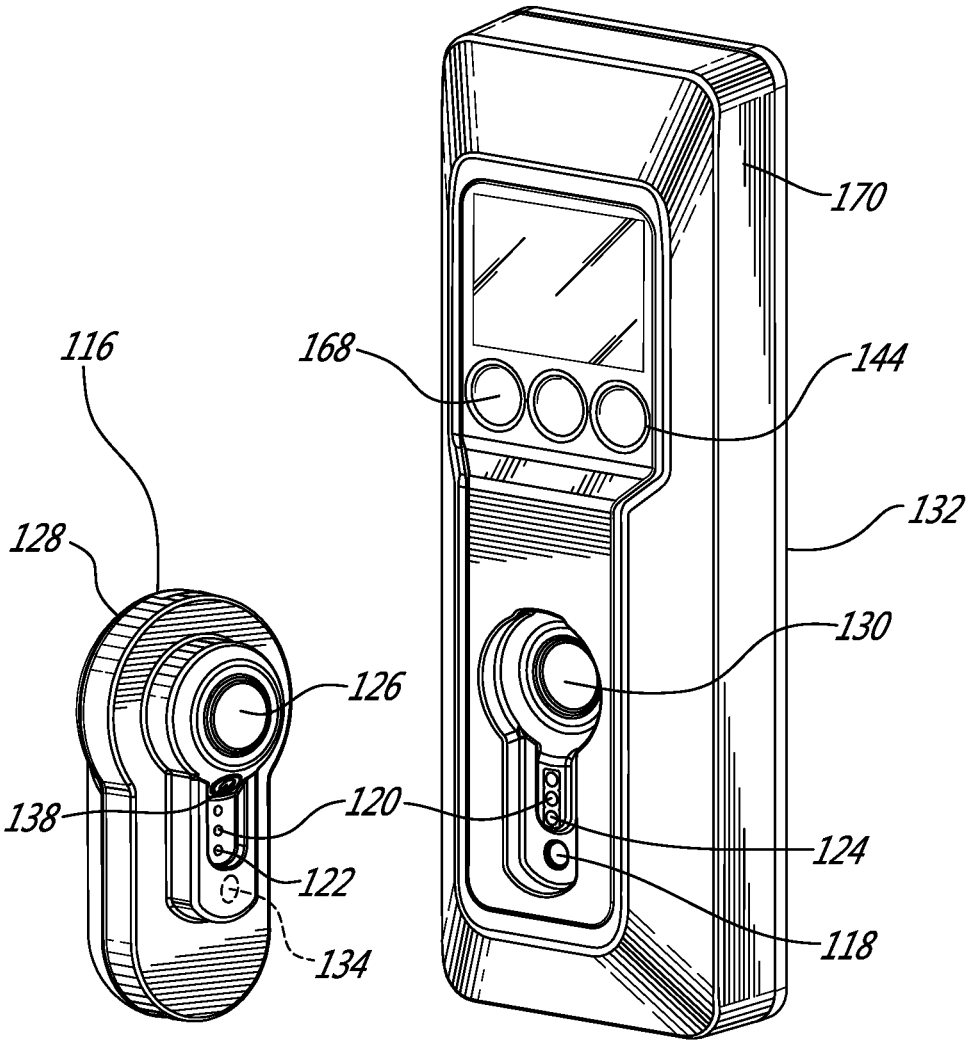
FIG. 5C provides a front perspective view of the key reader and key in FIG. 5A.

Referring to FIGS. 5A, 5B and 5C, in an alternative illustrative embodiment of the key reader 12, instead of a coded key card, the key 116 is comprised of a small fob like device which is received in a complementary keyport 118 in the key reader 12. The key 116 has stored thereon a coded ID or the like which is used to identify the key holder. When the key 116 is inserted into the keyport 118, the coded ID is transferred between the key 116 and the key reader 12 via an interface 120 comprised of a plurality of small conductive pins 122 which contact a complementary set of conductive contact plates 124 positioned within the keyport 118. Illustratively, the interface is bidirectional and can also be used to transfer information back to the key 116 from the key reader 12, for example confirmation of access which can be fed later into an appropriate administrative system or the like (not shown), as well as power, as discussed below.

Still referring to FIGS. 5A, 5B and 5C in order to retain the key 116 within the keyport 118, a magnet 126 is provided within the key housing 128 which attracts a ferrous plate 130 or complementary magnet (not shown) or the like positioned within the key reader housing 132. An additional small magnet 134 is provided in the key reader housing 132 which is attracted to a corresponding ferrous plate or complementary magnet (neither shown) or like embedded in the key housing 128 and ensures correct alignment of the key 116 in the key port 118.

Still referring to FIGS. 5A, 5B and 5C, the key 116 comprises a small battery 136 (not shown), typically rechargeable. When proximate, magnetic attraction causes the key 116 to be anchored within the key port 118, thereby interconnecting the small conductive pins 122 with the complementary set of conductive contact plates 124. At the same time, a micro switch 138 on the key housing is depressed thereby completing an electrical circuit, however in an alternative embodiment the completion of the interconnection between key 226 and reader 26 can be sensed by other means, for example via interconnection of the small conductive pins 122 with the complementary set of conductive contact plates 124. Of note is that in the present illustrative embodiment, the key 116 is used to power not only the key 116 but also the key reader 12, the DCU 16 and the door latch mechanism 14 via the interface 120. One particular advantage of this configuration is that the door access control system 10 requires no additional source of power, thereby eliminating the requirement for powering the door access control system 10 by other means, such as by providing a PoE, USB connection or mains current and transformer or the like. This allows the door access control system 10 to be used in places where such a system would otherwise typically not be able to be used, for example in cases where other sources of power are generally not available or in remote areas and the like.

Referring back to FIG. 5A, the key reader 12 additionally comprises a microprocessor/controller 140, a small OLED screen 142, a three button keypad 144, a power regulator 145, a USB interface 146, a status LED 148 and a DCU I/O interface 150 for communicating with the DCU(s) 16. A memory 152 is also provided which can include Flash Memory 154, EEPROMs 156, SRAM 158 and the like. Additionally, a Real Time Clock (RTC) and supercap circuit 160 are provided for.

Referring now back to FIG. 5B, the key 116 comprises, in addition to the magnets 126, 134 and battery 136, a microprocessor/controller 162, a USB interface 164, and a non-volatile memory 166 for storing access codes and the like as well as other information such as time stamps received from the DCU 16 via the key reader 12. The USB interface 164 can also be conveniently used for battery recharging, for example through provision of an appropriate base station (not shown) which can also be used to conveniently transfer information stored within the key 116 to an external administration system or the like (also not shown). Additionally the USB interface 164 can be used by the administration system to update access rights stored on the key, for example during transfer of a key from one user to another or when the access rights of a particular user are modified. In a particular embodiment the key could also include a wireless interface (not shown), such as WiFi, for programming and update purposes.

Referring back to FIGS. 1 and 5C, the keypad is comprised of three buttons 168 which, as described above, can be used to input an alphanumeric PIN number (not shown) or the like. The key reader 12 comprises a housing 170 which is secured to the door frame 18 or on a wall in proximity to the door 20. A communication cable (not shown) is fed through a hole bored in the frame or wall to interconnect the key reader 12 with the DCU 16 via their respective I/O interfaces 70, 150.

Still referring to FIG. 5C, in still another alternative embodiment, the key comprises a biometric key, such as a fingerprint, handprint, retina scan or the like, typically in combination with a pin number. In this regard, the key reader is equipped with an appropriate sensor and processing (both not shown) for acquiring the biometric key, and the pin number can be entered via the key pad 86, which are subsequently transferred to the DCU for verification.

Figure 6A:
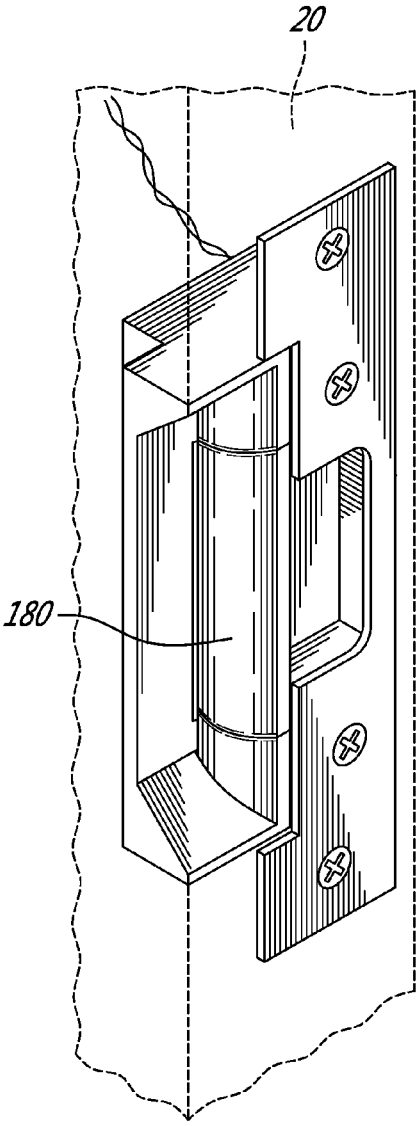
FIGS. 6A and 6B provide an orthonormal view of a door latch and a side plan view of a solenoid in accordance with a an illustrative embodiment of the present invention.
Figure 6B:
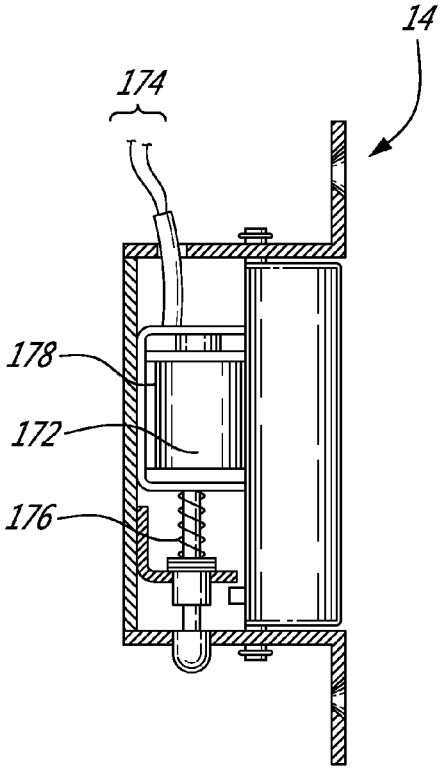

Referring now to FIG. 6 in addition to FIG. 1, the latch release mechanism 14 is comprised of a solenoid 172 wherein application of a suitable DC current across a pair of input terminals 174 causes a ferrous shaft 176 to retract within a magnetic coil 178, thereby disengaging the striker plate 152 and allowing the door 20 to be opened freely.

Referring to FIG. 2 in addition to FIG. 3, as discussed above, in order to ensure that the input voltage is sufficient to operate the latch release mechanism 14, a charge pump 66 is provided. In particular when the requisite operating power is provided by the key 116, the charge pump 66 serves to raise the relatively low 3 VDC input voltage to the voltage necessary to operate the solenoid of the latch mechanism, typically between 12 VDC or 24 VDC but in particular cases between 3 VDC and 28 VDC. Illustratively, and in order to supply the requisite current the 3 VDC input voltage is converted into the requisite output DC voltage (for example 12 VDC or 24 VDC) and used to charge a capacitor bank (not shown). Once charged, the capacitor bank is discharged over the inputs of the solenoid, thereby providing sufficient current of sufficient voltage for sufficient time to allow the user to open the door. In particular, the charge pump provides a short pulse current of several milliseconds duration and of respectively 12V and 24V sufficient to cause the solenoid to move to release the latch mechanism, and then provides a hold current of about 5V until the door is opened or a preprogrammed time limit reached.

Figure 7:
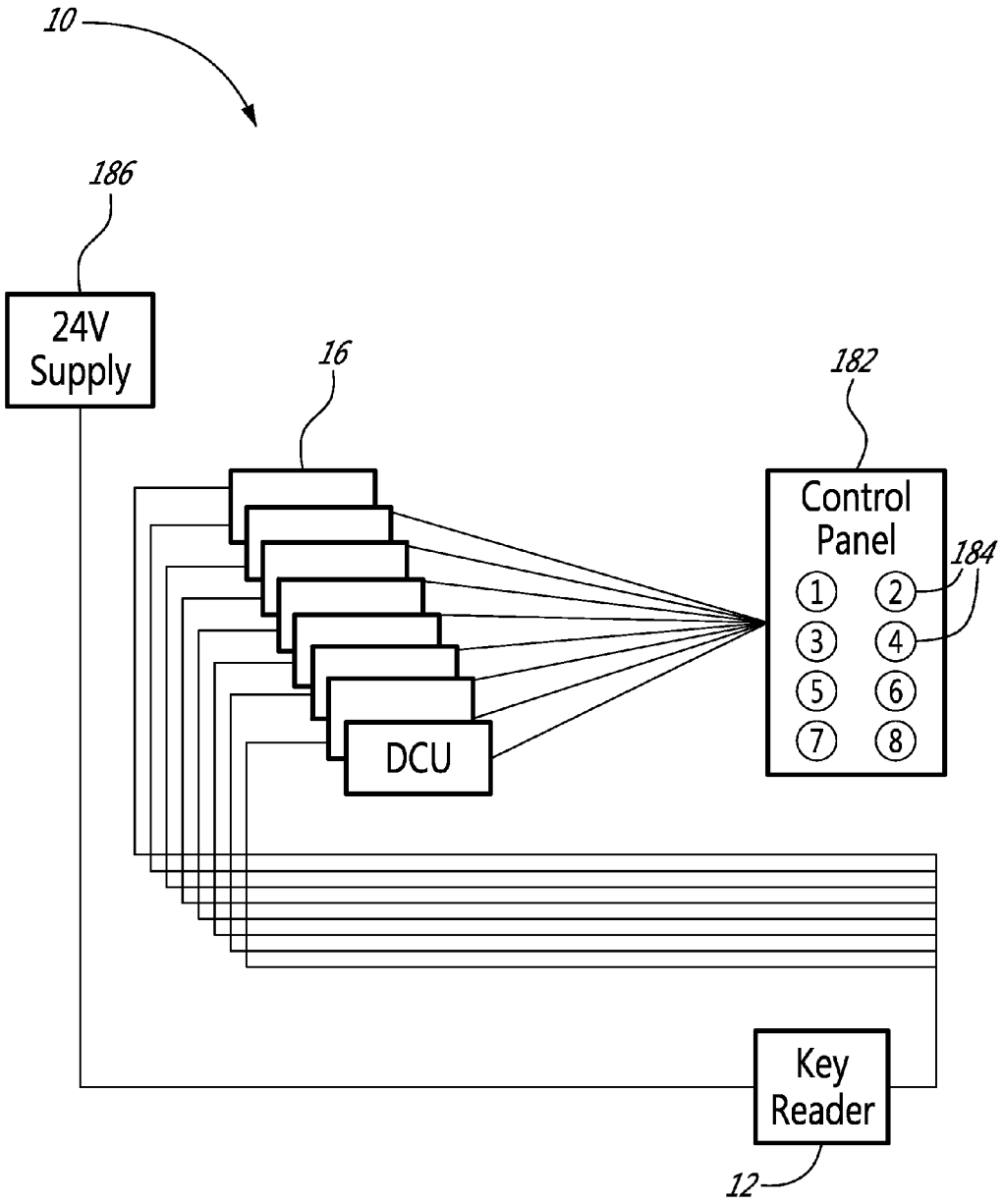
FIG. 7 provides a block diagram of an electronic door access control system installed within an elevator and in accordance with an alternative illustrative embodiment of the present invention.
Figure 8A:
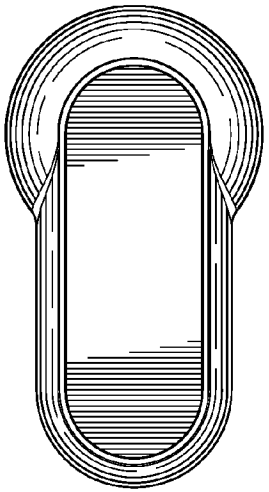
FIGS. 8A to 8E provide a series of views of the key shown in FIG. 5A.
Figure 8B:
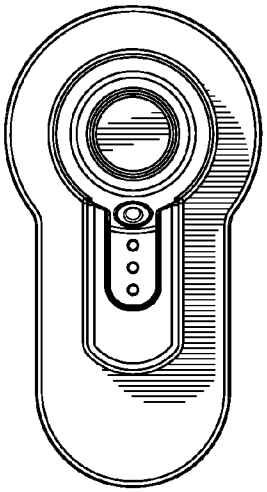
Figure 8C:
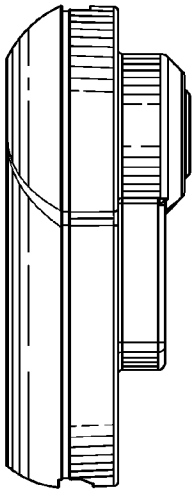
Figure 8D:
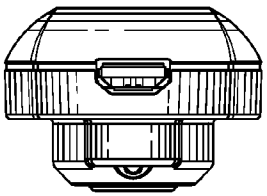
Figure 8E:
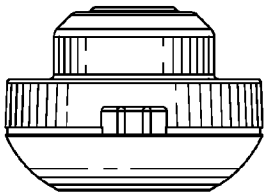

Referring now to FIG. 7, a discussed briefly above, in particular embodiments for particular applications, one or more key readers as in 12 can be combined with a number of DCUs as in 16 to provide access to a multiple limited access areas. In a particular embodiment, the door access control system 10 is used within an elevator and works in concert with the elevator control panel 182 to selectively enable a plurality of buttons as in 184, thereby allowing the coded ID cards to allow restricted access to individual floors. The door access control system 10 can also conveniently take advantage of the 24V supply 186 which is typically found within the elevator cabin thereby providing for easy retrofit without requiring additional wires and the like to be installed and/or fed into the elevator cabin.

Referring now to FIG. 8 in addition to FIG. 5B, different views of the key 116 are provided.

While this invention has been described with reference to the illustrative embodiments, this description is not intended to be construed to a limiting sense. Various modifications or combinations of the illustrative embodiment of the invention will be apparent to persons skilled in the art upon reference to the description. It is therefore intended that the described invention encompass any such modifications or embodiments.

The invention claimed is:

1. An electronic door access control apparatus for restricting access via a door installed in a door frame and comprising a lock mechanism having a latch bolt and using a key comprising a unique coded ID sequence, the apparatus comprising:

a key reader for reading the key and comprising a tamper switch;

a latch release mechanism;

a door control unit separate from said key reader and said latch release mechanism, installed in the door frame proximate to said key reader and said latch release mechanism and comprising a controller and memory comprising a plurality of predetermined allowed coded ID sequences, wherein said door control unit is operationally connected to said tamper switch; and an encrypted binding interconnecting said key reader and said door control unit, wherein said encrypted binding is established by one of an external programming device and a master key card;

wherein when the key is positioned proximate to said key reader, the coded ID sequence is read by the key reader and relayed to said door control unit via an encrypted communication channel interconnecting said key reader and said door control unit for processing, wherein when the coded ID sequence matches one of said plurality of predetermined allowed coded ID sequences, said door control unit actuates said latch release mechanism, thereby allowing the door to be opened, and further wherein when said door control unit detects tampering of said key reader via said tamper switch, said encrypted binding between said key reader and said door control unit is terminated, thereby preventing actuation of said latch release mechanism.

2. The apparatus of claim 1, wherein said key reader comprises a screen and an input interface for manually entering a password and further wherein said password is relayed to said door control unit via said encrypted communication channel for processing with the unique coded ID.

3. The apparatus of claim 2, wherein said input interface comprises one of a key pad and a proximity sensor using an electric field for sensing and recognizing the motion of a user's hand or finger.

4. The apparatus of claim 1, wherein the lock mechanism comprises a latch bolt and wherein said latch release mechanism is configured for receiving said latch bolt and comprises a striker plate and a solenoid and further wherein said door control unit actuates said latch release mechanism by activating the solenoid, thereby releasing said striker plate.

5. The apparatus of claim 1, wherein once terminated said encrypted binding between said key reader and said door control unit can only be reestablished by reprogramming said door control unit.

6. The apparatus of claim 1, wherein said key reader is interconnected with said door control unit and said tamper switch via a wired connection.

7. An electronic door access control system for restricting access via a door comprising a lock mechanism, the system comprising:

a key comprising a power source, a unique coded ID sequence and a key memory;

a key reader for reading said key;

a latch release mechanism;

a door control unit comprising a controller, a real time clock, a door control unit memory and a door identifier; and an encrypted binding interconnecting said key reader and said door control unit, wherein said encrypted binding is established by one of an external programming device and a master key card, wherein when said key is positioned proximate to said key reader, said power source provides power for operating said key reader, said latch release mechanism and said door control unit, the coded ID sequence is read by said key reader and relayed to said door control unit and further wherein when the coded ID sequence matches one of said plurality of predetermined allowed coded ID sequences, said door control unit actuates said latch release mechanism, thereby allowing the door to be opened, and further wherein a time stamp and said door identifier is relayed to said key for storage in said key memory, and and further wherein when said door control unit detects tampering of said key reader via said tamper switch, said encrypted binding between said key reader and said door control unit is terminated, thereby preventing actuation of said latch release mechanism.

8. The system of claim 7, wherein said key is held removeably against said key reader by a magnet.

9. The system of claim 8, wherein said key further comprises a normally open microswitch between said power source and at least one of said pair of contacts and wherein when said microswitch is closed by contact with said key reader an electrical circuit is completed between said power supply and said contacts.

10. The system of claim 7, wherein once said solenoid is actuated, a voltage across said output of said charge pump is lowered to a holding voltage lower than said actuating voltage.

11. The system of claim 7, wherein said key voltage is less than 3 volts and said actuating voltage is greater than 12 volts.

* * * * *